United States Patent [19]

Sadlak

[11] Patent Number: 4,908,897

[45] Date of Patent: Mar. 20, 1990

[54] SKI BOOT FITTING STAND

[76] Inventor: Michael W. Sadlak, 44 County La., Vernon, Conn. 06066

[21] Appl. No.: 309,705

[22] Filed: Feb. 13, 1989

[51] Int. Cl.[4] ..... A43D 1/00

[52] U.S. Cl. ..... 12/123; 33/3 A; 12/120.5

[58] Field of Search ..... 12/120.5, 123, 125, 12/142 P, 142 N; 223/114, 116, 117, 120; 33/3 R, 3 A; 280/633, 636; 248/121

[56] References Cited

U.S. PATENT DOCUMENTS

| | | | |
|---|---|---|---|
| 2,822,613 | 2/1958 | Lundberg | 280/633 |
| 3,035,289 | 5/1962 | Wakeman | 12/120.5 |
| 3,375,583 | 4/1968 | Kennedy | 33/3 A |
| 3,726,015 | 4/1973 | Neumann | 33/3 A |
| 4,022,491 | 5/1977 | Powell | 280/633 |
| 4,567,617 | 2/1986 | Limbach | 12/142 P |
| 4,666,070 | 5/1987 | McClung | 223/117 |
| 4,683,876 | 8/1987 | Changras | 223/113 |

*Primary Examiner*—Steven N. Meyers
*Attorney, Agent, or Firm*—Peter R. Bahn

[57] ABSTRACT

A portable ski boot fitting stand used to temporarily secure a pair of alpine ski boots, or the like, to assist the process of boot fitting by allowing the user to apply similar skiing forces to the boots in the forward and lateral direction. Another feature elevates the toes to assist fitting of boots having foam injected liners.

7 Claims, 4 Drawing Sheets

SKI BOOT FITTING STAND

FIELD OF INVENTION

This invention is a device with two identical adjustable locking mechanisms used to assist in the fitting of alpine ski boots, or the like, to human feet.

BACKGROUND OF THE INVENTION

Determining the proper size and fit of alpine ski boots, or the like, made of plastic or relatively rigid, non-conforming material that pivots or flexes only slightly about the ankle axis, can be an uncertain, time consuming process due to the nature of the boot's material and intended use. This process always uses trial and error to arrive at a fit which is comfortable, yet functional.

Two types of boot fitting techniques are currently being used. The first, called boot sizing, involves selecting the proper boot size for a buyer. The second called custom boot fitting, involves modifying the boot's shell or liner to conform to the user's feet. This service is usually requested by users who have tested the boot's fit during alpine skiing and have experienced foot movement inside the boot or localized pain due to the foot's irregularities. The main purpose of custom boot fitting is to obtain greater immobilization of the foot inside the boot for better control of the ski and eliminating foot pain. Both purposes are achieved by adding pads or altering the boot's shell or inner liner as needed. A better form of custom boot fitting is injecting special foam into the boot's liner, that when cured the liner takes the exact shape of the foot.

If the buyer of a pair of boots is not fitted properly and purchases the wrong size, this will soon become apparent when using the boots in their intended use. Consequently, proper boot sizing at purchase is highly desirable.

The typical boot sizing procedure for a buyer is to try on a pair of boots, walk to test for comfort, stand stationary to test the boot's forward flex characteristics by bending the knees forward with as much force as is achievable, roll both ankles left, then right, to apply a side flex on the boot to test the foot's play when making a turn on skis, tighten the buckles, and make other adjustments. This procedure is often repeated, with the boot size changing if it is clearly evident of a wrong size, or changing boot brands if uncomfortable for whatever reason. During custom boot fitting, the above procedure is also used.

The main flaw with these techniques is that the motion of flexing the knees forward and rolling the ankles, which is essential to properly ski alpine style in a controlled and comfortable posture, cannot be sufficiently duplicated because (1) the boot's heel, not being held stationary, lifts during forward flexing, causing the leg to pivot on the toe portion of the boot's sole, instead of about the ankle axis as it does during skiing and (2) there is not enough force restricting the boot from side flexing when a rolling motion of the ankles is applied, causing a poor assessment of how the boot feels when making a turn. Turns are achieved by positioning each ski on its edge, also known as edging the ski.

Another lesser flaw is the walking process. The primary function of the alpine ski boot is to immobilize the foot during skiing, which may not always be comfortable when walking. Walking with alpine ski boots tends to push the foot forward. If, during this process, the toes have sufficient room and are not contacting the inside of the boot, the buyer is deceived into believing the boots must be the correct size and fit because they are comfortable. However, in a properly fitted boot, the toes should make slight contact with the boot when walking, causing a small amount of discomfort. An alpine boot is designed primarily to secure the foot when both the knee and ankle are bent forward, as occurs during the forward flexing action while skiing. The bending at the ankles forces the toes back into the boot's heel whereas walking will cause more joint movement, forcing the toes forward. While more room in the toe section would provide more comfort when walking, it would cause the foot to move excessively during skiing, causing a lesser degree of ski control and possible pain. Therefore, it is important to purchase the proper boot size to fully enjoy the sport. It is in the buyer's best interest to make a purchase decision with emphasis on the primary use of the boot. A means of duplicating the forces caused by leg movement, during skiing, against the boots, would provides a better assessment of the fit than walking and will contribute more toward the purchase decision.

In addition to not being able to sense true foot movement inside the boot with the current fitting technique, the buyer also cannot accurately test the flex characteristics of the boot's material before purchase. Flex characteristics vary with boot design to satisfy the various levels of skiing abilities and it is important to the buyer to purchase a boot that has flex characteristics suitable to their ability. Typically, advanced and high speed skiers use hard flexing boots.

Custom boot fitting service is considered an art by those in the industry, requiring extensive knowledge of the anatomy of the foot, boot design, construction and reaction of the foot inside the boot during skiing or during other activities in the intended use of the boot. With the current fitting techniques, custom boot fitting often involves the trial and error method requiring several visits to assure the best possible fit. Because of the time involved, labor charges are high and therefore any means to reduce this time is desirable.

Custom boot fitting of foam injected boots require the foot to be in the proper skiing postion inside the boot when the foam cures. The proper postion has the foot's heel inside the boot's heel cup with the ankles and knees sightly bent forward. Currently, this is achieved by having the user, wearing the boots, stand unsecured on an inclined platform to elevate the toes. The foam is injected into the liner and the user must remain stationary while the foam cures. Any movement or improper positioning of the foot inside the boot will cause a loose fit. It is therefore also desirable to secure the boots in an elevated position when performing this specialized boot fitting process.

SUMMARY OF THE INVENTION

This invention is a device for assisting in the fitting of boots used primarily for recreational activities. It is particularly designed to quickly and easily secure a wide range of alpine ski boot sizes to a platform. But it, can be modified to accommodate other boot types, i.e. plastic hockey skates or the like.

Current boot fitting techniques are time consuming, often inadequate and fail to duplicate the actual total movement of the legs when the boots are worn during alpine skiing. This failure occurs because flexing of the boots can not be achieved when the boot soles are not held stationary, as they are by alpine ski bindings. As a result, the use of said invention presented here will provide a more accurate boot fitting and sizing procedure, reducing the time associated with the trial and error technique currently used to arrive at a good boot fit.

The boot fitting stand is comprosed of a base made of two horizontally spaced, rubber mounted rails, attached to two cross rails. Each long rail has one manually operated toggle clamp with 'V' shaped cups for securing the boot's heel to these rails. Each clamp is mounted on a plate that is captured in a slot in each of the long rails. The slot allows the clamp to slide freely in the longitudinal direction for easy adjustment for the range of boot sizes. Also attached to each long rail is a fixed-mounted toe cup of the same 'V' shape for preventing the boot's toe from lifting. A plate, for elevating the toes, is attached to each rail which is mounted in front of the fixed toe cups. The plate pivots down, when needed, to perform special fitting of boots with foam injected liners.

A user who wishes to assess how a pair of semi-rigid boots fit before purchase or use, puts the boots on, secures the buckles and places one boot toe into the toe retaining cup, then places the other. Next, the user slides one toggle clamp toward the boot's heel until contact is made and activates the toggle clamp handle that locks the boot's heel to the long rails. This procedure is repeated for the other toggle clamp.

The user can then flex the boots forward and apply a side force. Forward flex is achieved by bending at the knees and ankles, and a side force to the boot is applied by rolling the ankles and lower leg laterally. The user can also lead backwards, but this motion contributes little to assessing the fit of alpine ski boots. By performing these flex motions on the boots, the user can more accurately test how the feet feel and react inside the boot under similiar loads which typically occur during actual use of said boot during alpine skiing. After this short test, the user will usually have a better understanding of the fit and usually can identify any potential problems. The user can then provide accurate feedback to a professional boot fitter who can recommend the appropriate solutions. Several common solutions are adding pads to eliminate pressure points, removing or expanding the outer plastic shell for short wide feet or simply selecting another boot size, brand or model. After each change or modification, the procedure is repeated until the user is satisfied with the boot's fit. The use of this invention contributes to assuring a properly selected, better fitting and more comfortably functioning boots, in less time.

Provisions are provided for installing standard ski poles, or the like, into the base to allow the user to grasp them while performing the various flexing motions. The poles assist in properly positioning the upper and mid-section of the body to duplicate actual skiing. This helps to provide a better assessment of how the legs and upper torso react during the flexing exercise and particularly how the feet react while inside the fixed-mounted boot. Additionally, the poles act as a safety feature by reducing the possibility of leaning too far forward or sideways.

The base design and/or physical shape is not limited to that shown but must be long enough to sustain moderate forces in the forward, sideway and rearward direction, without the user falling. The the object of this invention is as follows:

to provide a light weight mobile stand with hand operated locking mechanisms for temporarily securing two ski boot soles, or the like.

to provide a clamping mechanism that is adjustable to accommodate an entire range of popular boot sizes.

to provide a clamping mechanism that when actuate, locks the boot's heel to the base by a downward vertical force.

to incorporate into the same clamping mechanism the ability, that when actuated, simultaneously locks it from moving in the horizontal plane or longitudinally along the long rails.

to provide these functions of the clamping mechanisms without requiring additional tools for adjustment.

to provide a means of restraining the boot's toe and heel without marring the boot's surface.

to provide a means of installing two standard ski poles vertically.

to provide a base length sufficient in front of the toe cup such that the user will not fall forward when applying moderate forward force on the boots as well as ample length in the rear, and width, for the same purpose.

DETAILED DESCRIPTION OF THE INVENTION

Figure 1:
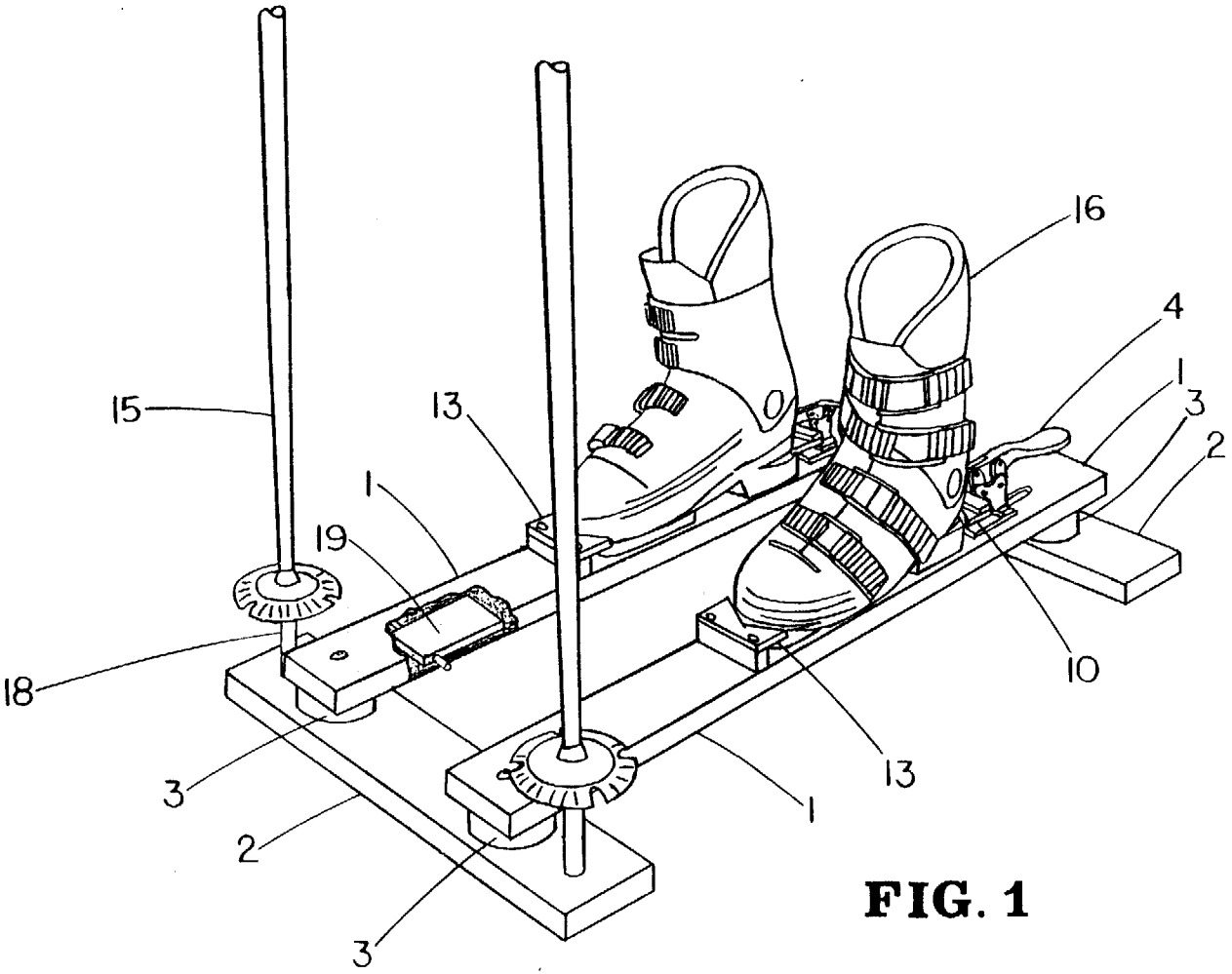
FIG. 1 shows a perspective view, looking from the front to the rear, of the ski boot fitting stand with two alpine ski boots in position.

FIG. 1 shows the boot fitting stand's major components comprising of a base assembly which is comprised of two base rails 1, two cross rails 2, (both made from "C" shaped channel aluminum) and four rubber pads 3, Other components are two toe cups 13, two clamp mechanisms 4, two pole support holders 18 and a cut-away view of the toe elevating option showing the elevating plate 19.

It is evident in FIG. 1 that the partial view of two ski poles 15 are located in stand's front section; that they are spaced apart approximately on 16" centers and are inserted in the pole support holders 18 which are attached to the front cross rail 2 only. A toe elevating option, which raises the front of the stand, is shown in a cut-away view exposing the elevating plate 19 that is located inside and attaches to the base rail 1. The toe cups 13 are located on the base rail 1 back from the elevating plate 19; that the two clamp mechanisms 4 each are located near the rear on the base rails 1. It is also evident that the two alpine boots 16 are placed between the boot toe cup 13 and heel cup 10. The heel cup 10 is attached to the clamp mechanism 4.

FIG. 1 also shows that the rubber pads 3 are located between the base rails 1 and the cross rails 2 at each corner where the two rails intersect. The cross rails 2 contact the floor and provide stability during the boot flexing exercises. A partial view of the slot which the clamp mechanism 4 slides in, can be seen toward the rear of the base rail 1. The elevating plate 19 is shown in the retracted or storage position.

Figure 2:
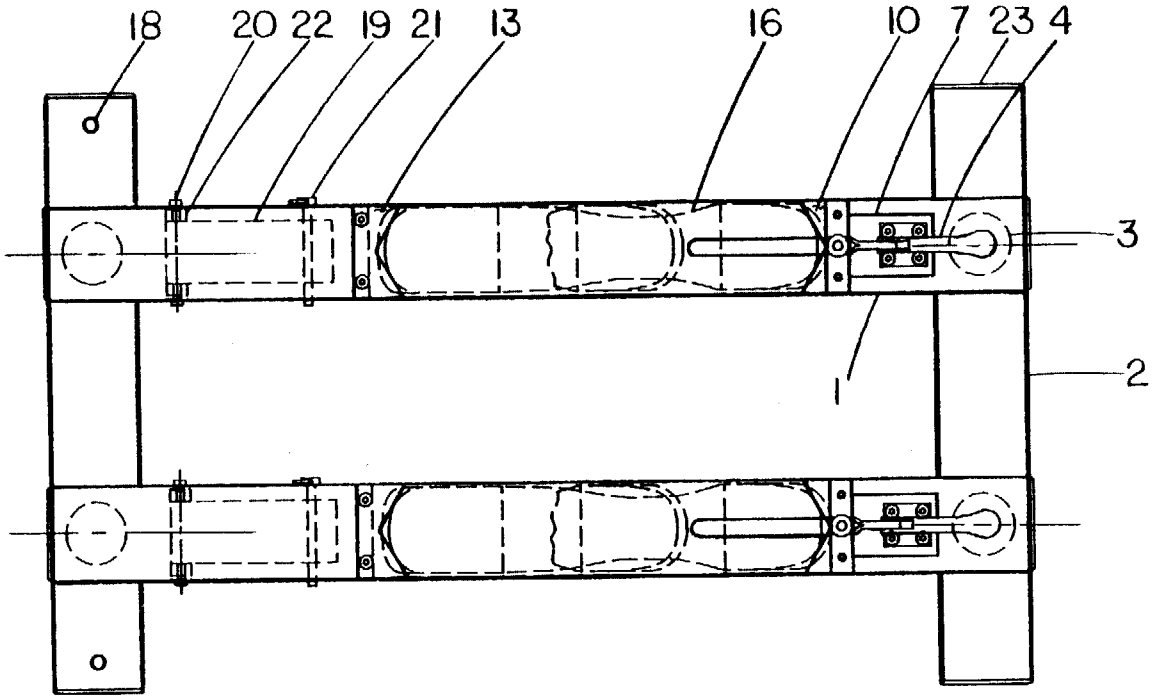
FIG. 2 shows a top view of the stand.

FIG. 2 is a top view of the stand identifying most of the components that comprose the ski boot fitting stand. Two pole support holders 18 are shown located outside the base rails 1 and attached to the center of the cross rail 2. A suitable spacing of the ski poles 15 provide the user with a comfortable grip. The elevating plate 19, also, shown in the retracted position is dashed because it is located inside the base rail 1 and hidden from the user's view. The elevating plate 19 pivots about the pivot screws 20, with the two plate spacers 22 centering it inside the base rail 1. The locking pin 21 keeps the elevating plate 19 inside the base rail 1 when the toe elevating option is not used. The locking pin 21 is shown inserted through holes, called elevating plate storage holes, in the base rail 1 side. When the boot stand front is to be elevated to perform foam boot fitting, the locking pin 21 is removed from the location as shown. Both elevating plates 19 are then swung down, and the locking pin 21 relocated to another set of holes (not shown FIG. 2) to lock the elevating plate 19 in place.

Also, shown in FIG. 2 is the largest boot 16 capable of fitting in the stand. The toe or front of the boot is kept from lifting by a the toe cup 13. The heel cup 10 is attached to the clamp mechanism 4 and contacts the boot's heel when the clamp handle 5 is activated, keeping the boot's heel from lifting during the flexing exercises. Both cups are made of strong plastic to prevent marring of the boots surface.

The clamp mechanism 4 is one part of a complete sliding assembly, called the clamp assembly. The clamp mechanism 4 has a handle 5 and the mechanism is attached to a clamp plate 7 which slides on the top of the base rail 1 during boot size adjustment. Each end of the base rails 1 and cross rails 2 are covered with plastic end plugs 23 for appearance and safety. The location of the four rubber pads 3, shown as dashed circles because they are beneath the base rails 1, is also evident.

Figure 3:
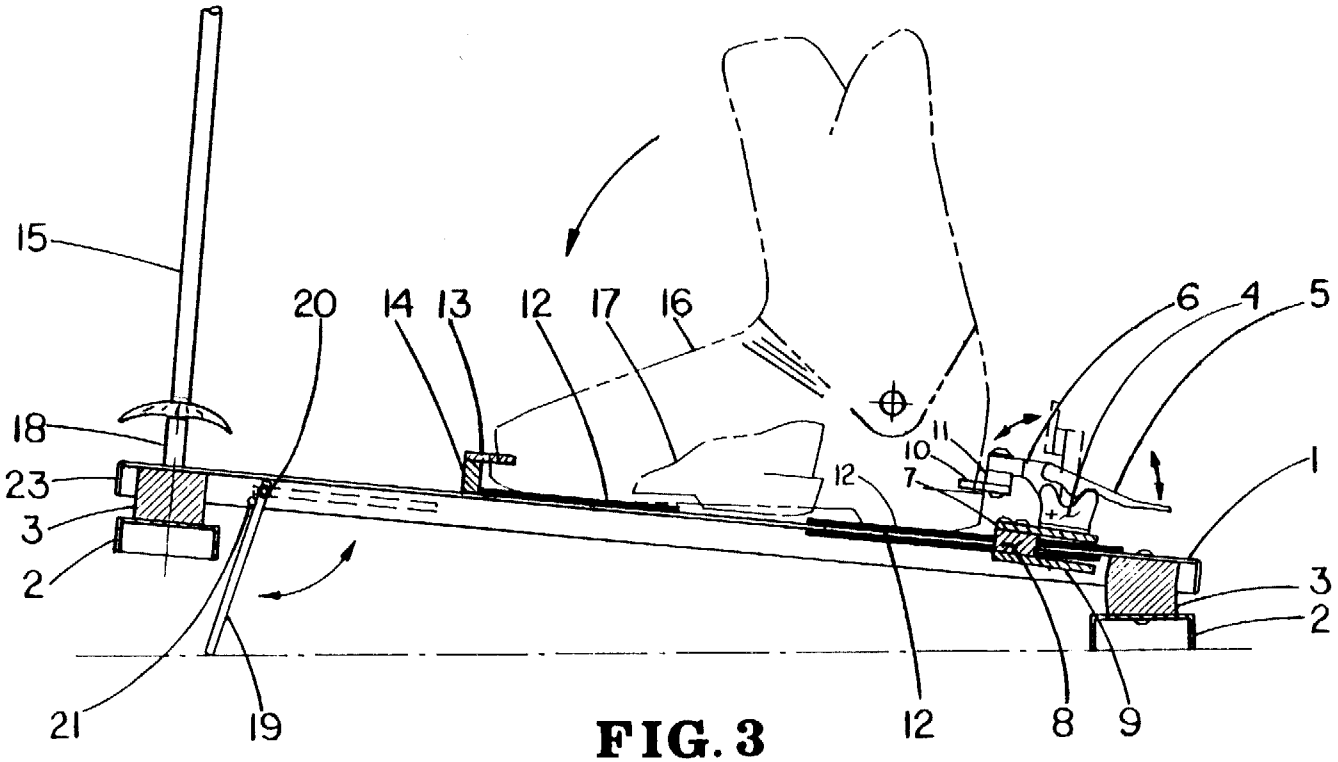
FIG. 3 shows a cross-section side view of the toggle clamp mechanism and boot stand in the elevated position.

FIG. 3 shows a cross section view of the entire length of the boot stand with the elevating plate 19 locked into position to elevate the front of the stand, for purposes of performing boot fitting of foam injected liners. When this type of boot fitting is performed, the front of the stand is elevated first before the user steps onto the base rail 1 to secure both boot soles. It can be seen that the elevating plate 19 has been pivoted down about the pivot screw 20 and stops against the locking pin 21 which is shown relocated to the locking holes from the positon shown in FIG. 2. The pivot screws 20 are through each side of the base rail 1.

FIG. 3 also shows the largest boot 16, approximate size 15, as it is clamped into position and shows where the heel of the smallest boot 17, approximate size 6, would be located. Forward flexing of the boot is indicated by the curved arrow located in the center of figure.

All alpine boots have flat surfaces extending from the toe and heel of the outer shell to secure the boots to the ski. Securing the boots to the fitting stand is accomplished using the same flat surface. The boot's toe is seen under the stationary toe cup 13 which is properly spaced by the toe cup spacer 14. When the boot is secured to the base rail 1, the heel of the boot also rests under the heel cup 10 as shown.

The components comprising the entire clamp assembly are visible in FIG. 3. The assembly slides freely, for adjusting to various boot sizes, on top of the base rail 1 and guided by slots milled in the base rail 1. The entire clamp assembly is comprised of a commercially available 4-bar linkage toggle clamp mechanism 4. Two parts of this mechanism are identified as: the clamp arm 6, that has attached the heel cup plate 11 and the heel cup 10, and the clamp handle 5 that is used to activate and release the linkage of the clamping mechanism 4. The clamp mechanism 4 is attached to the clamp plate 7 that slides on the base rail 1 top. A spacer 8 is between clamp plate 7 and retaining plate 9. The retaining plate 9 is located inside the "C" shaped channel of the base rail 1 and retains the clamp assembly from excessive lifting and in the slot. The spacer 8 is slightly thicker than the cross-section of the base rail 1 and slides in the slot. It also properly gap the clamp plate 7 and retaining plate 9 to allow the clamp assembly to slide easily.

The clamp assembly shown in FIG. 3, is in the locked position with the clamp handle 5 and clamp arm 6 almost parallel to the base rail 1 with the heel cup 10 contacting the boot's heel. Also visible is the angulation of the clamp plate 7 and retaining plate 9 in relationship to the base rail 1. To unlock the boot, the clamp handle 5 is moved about 75 degrees up, away from the base rail 1 toward the boot. This action simultaneously rotates the clamp arm 6, with heel cup 10 and heel cup plate 11 attached, away from the boot's heel to rest in the position as shown in FIG. 3.

The unique locking feature of the clamp assembly locks the boot's heel to the base rail 1 while simultaneously locking the clamp assembly from sliding away from the heel during the boot flexing exercises. The advantage of this feature is faster, less complicated adjustments made to accommodate the various boot sizes without the use of tools.

The bi-directional locking forces are accomplished by the angulation causing a wedging action of the clamp plate 7 and retaining plate 9 between the base rail as shown. Attached to the top and bottom of the base rail 1 is a special protective adhesive tape 12 that allows, during the wedging action, the sharp edges of the clamp base 7 and retaining plate 9 to depress the tape slightly providing a locking grip horizontally along the long axis of the base rail 1. The wedging action occurs when the clamp handle 5 is activated to clamp the heel cup against the boot's heel. Some of the vertical heel clamping force is used to lifts the entire clamp assembly slightly, forcing the rear edge of the clamp base 7 to depress the tape attached to the top of the base rail 1 and simultaneously forcing the front edge of the retaining plate 9 against the tape located underneath the base rail 1.

This non-damaging wedging action of the two edges into the protective tape 12 causes the entire assembly to be adjusted for an infinite number of positions to accommodate the entire range of boot sizes, limited only by the slot length. When the clamp handle 5 is activated up, releasing the locking forces, the clamp base plate 7 and retaining plate 9 become released from the wedging action, with the base plate 7 resting flat on the protective tape 12 on the base rail 1 top, and allowing once again the entire clamp assembly to move freely.

The same protective tape is also attached to the base rail 1 near the toe cup 13 for protection against base rail scratching and also provides a small amount of friction between the boot 16 and base rail 1.

FIG. 3 also shows how the rear rubber pad 3 is attached to the upper base rail 1 and lower cross rail 2. In addition, it shows how the rubber pad 3 flexes to keep the cross rail 2 contacting the floor when the front of the stand is elevated.

Figure 4:
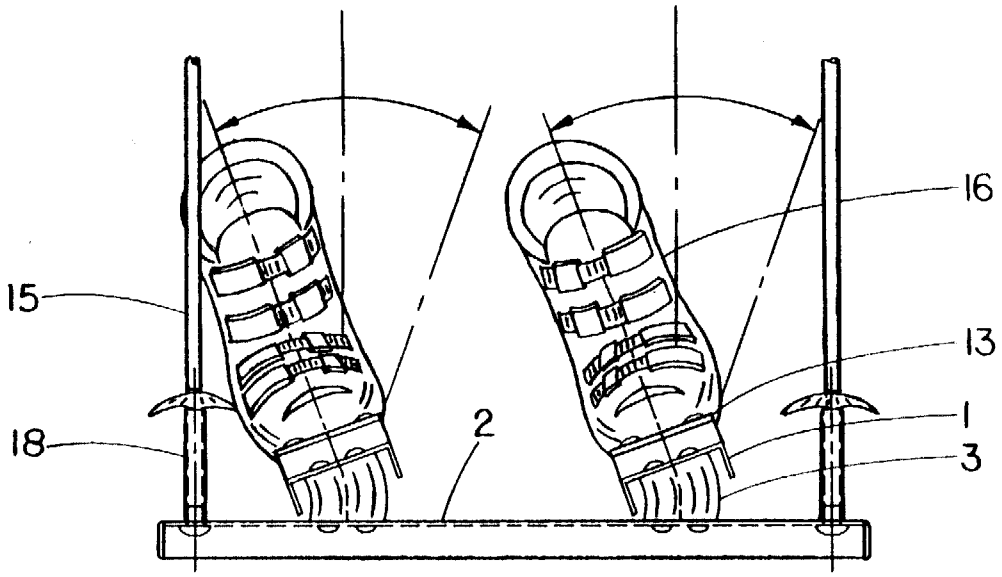
FIG. 4 shows a front view with two alpine ski boots in the extreme side flexing position.

FIG. 4 is a front view showing two alpine boots 16 in the extreme left side flexing position. Both boots can flex from the position shown, approximately 30 degrees to the extreme right, as indicated by the directional arrows. It is evident how the rubber pads 3 flex under side loading and the relationship between the base rail 1 and the cross rail 2 under these flexing conditions. Also shown is the means of attaching the pole support holder 18 to the cross rail 2 and how the ski pole 15 is held inside the holder. The toe cup 13 is shown for reference.

What is claimed is:

1. A ski boot fitting stand comprising: a floor mounted base for securing two alpine ski boots, said base possessing two long "C" shaped base rails spaced apart horizontally and connected together at both ends of said rails by two shorter cross rails of the same "C" shape, forming a rectangular shape; said base rails being vertically spaced apart from said cross rails by means of rubber pads at each corner; said base rails each having a raised overhung cup for preventing the toe of said boot from lifting; possessing a clamping mechanism captured in a slot of each base rail for securing said boots heel to said base rail; the front of said base rails each having attached elevating plates that pivot down to raise the front cross rail off the floor, while the rear cross rails maintain contact; said front cross rails having attached two vertically positioned tubes for holding alpine ski poles in the vertical attitude.

2. A ski boot fitting stand as described in claim 1 wherein said clamping mechanism can be adjusted, with no additional tooling, to accommodate and prevent lifting of the lower half or sole portion of said boots to said base rails for all sizes of adult alpine ski boots.

3. A ski boot fitting stand as described in claim 2 wherein said clamping mechanism is a commercially available locking device attached to an upper plate that is guided by a slot and slides on protective tape adhesively attached to the top surface of said base rail; said spacer being located in said slot and between said upper plate and lower plate; said lower plate being inside or underneath said "C" shaped base rail capturing and limiting vertical motion of said clamping mechanism; said protective tape also being adhesively attached between said lower plate and underside of said base rail.

4. A ski boot fitting stand as described in claim 3 wherein said clamping mechanism, when activated manually by a handle, simultaneously applies a bi-directional force on the boot's heel and upon said upper & lower plates locking the boot's heel in the vertical direction and said plates from moving in the horizontal direction along said base rail, said boot's heel being mechanically locked by the clamping mechanism's linkage, said upper & lower plates attached to said clamping mechanism being locked horizontally by a wedging action of said plate opposite edges between said base rail causing slight depression of said protective tape, said wedging force caused by slight upward movement of front of said plate when said clamping mechanism is activated applying a downward force on said boot's heel.

5. A ski boot fitting stand as described in claim 1 wherein after the lower portion of said boots are secured to said base rail via said clamping mechanism, said boots upper half can be flexed forward, by human forces, pivoting about said boot's ankle rivet.

6. A ski boot fitting stand as described in claim 5 wherein said boots can be side flexed, by human forces, by simultaneously rolling both ankles in the same lateral direction to said base rail; said base rail rotating about the longitudinal axis approximately plus or minus 20 degrees from the vertical, wherein each set of said rubber pads compresses on one side and extends on the other to allow a controlled rotating motion.

7. A ski boot fitting stand as described in claim 1 wherein each said elevating plate is held inside said "C" shaped base rail when not being used, by a removable pin inserted into holes on both sides of said base rail, once said pin is removed said elevating plate can pivot about two screws downwards, said elevating plate is locked from further rotation by said pin being inserted into another set of holes.

* * * * *